US010722901B2

(12) United States Patent
Bynèlius

(10) Patent No.: US 10,722,901 B2
(45) Date of Patent: Jul. 28, 2020

(54) SHREDDING DEVICE AND A METHOD USING SUCH A SHREDDING DEVICE

(75) Inventor: Jan-Olof Bynèlius, Djursholm (SE)

(73) Assignee: NORDISKA EKOFIBER NEF AB, Djursholm (SE)

( * ) Notice: Subject to any disclaimer, the term of this patent is extended or adjusted under 35 U.S.C. 154(b) by 296 days.

(21) Appl. No.: 13/574,199

(22) PCT Filed: Jan. 13, 2011

(86) PCT No.: PCT/SE2011/050034

§ 371 (c)(1),
(2), (4) Date: Oct. 12, 2012

(87) PCT Pub. No.: WO2011/090422

PCT Pub. Date: Jul. 28, 2011

(65) Prior Publication Data

US 2013/0020422 A1 Jan. 24, 2013

(30) Foreign Application Priority Data

Jan. 22, 2010 (SE) ..... 1050071-8
Oct. 19, 2010 (SE) ..... 1051088-1

(51) Int. Cl.
*B02C 18/00* (2006.01)
*B02C 18/22* (2006.01)
(Continued)

(52) U.S. Cl.
CPC ..... *B02C 18/2291* (2013.01); *B02C 18/28* (2013.01); *E04F 21/085* (2013.01)

(58) Field of Classification Search
CPC ..... B02C 18/28; B02C 18/2291; E04F 21/085
(Continued)

(56) References Cited

U.S. PATENT DOCUMENTS 2,919,075 A * 12/1959 Pfeiffer ..... 241/160
4,151,961 A * 5/1979 Makofka ..... A01K 5/002 171/63

(Continued)

FOREIGN PATENT DOCUMENTS

NL 8204888 7/1984

OTHER PUBLICATIONS

International Search Report for corresponding International Application No. PCT/SE2011/050034 dated Jul. 28, 2011.

*Primary Examiner* — Faye Francis
(74) *Attorney, Agent, or Firm* — Gabriela B. Tomescu, Esq.; Bergenstrahle & Partners AB

(57) ABSTRACT

The invention relates to a shredding device (1) used for picking apart compressed blocks (2) of loose-fill cellulose thermal insulation material. It comprises a chute (3) with a chute inlet (3*a*) configured to receive the insulation block (2). Further, it comprises a shredder (4) rotatable around a substantially horizontal axis (A), mounted at an outlet (3*b*) of the chute (3). The device (1) is characterized in that the rotatable shredder (4) is a cylinder with protruding grating pins (5) arranged on its mantel surface (4'), where the pins (5) have a length shorter than the radius of the cylinder and are adapted to grate, pick apart and fluff the insulation from the compressed block format (2) into a fluff material with an even density. Further, the invention relates to a method for picking apart loose-fill cellulose thermal insulation material compressed into a block (2).

14 Claims, 2 Drawing Sheets

(51) Int. Cl.
*E04F 21/08* (2006.01)
*B02C 18/28* (2006.01)

(58) Field of Classification Search
USPC ..... 241/60, 277, 294
See application file for complete search history.

(56) References Cited

U.S. PATENT DOCUMENTS

| | | | | | |
|---|---|---|---|---|---|
| 4,978,252 | A | | 12/1990 | Sperber | |
| 5,211,345 | A | * | 5/1993 | Siebenga | A01D 87/127 119/57.91 |
| 5,255,860 | A | * | 10/1993 | Timmons | B02C 4/12 241/280 |
| 5,340,040 | A | * | 8/1994 | Bussiere | A01F 29/005 241/101.761 |
| 5,419,498 | A | * | 5/1995 | Rasmussen | D21B 1/08 241/280 |
| 5,556,040 | A | * | 9/1996 | Irie et al. | 241/24.29 |
| 5,590,839 | A | * | 1/1997 | Condrey | A01F 29/005 241/186.35 |
| 6,109,488 | A | | 8/2000 | Horton | |
| 9,492,827 | B2 | * | 11/2016 | Daniels | B02C 4/08 |
| 2006/0024456 | A1 | | 2/2006 | O'Leary | |
| 2007/0057100 | A1 | | 3/2007 | Svendsen | |
| 2008/0210798 | A1 | * | 9/2008 | Hall | A47C 3/00 241/294 |
| 2012/0312907 | A1 | * | 12/2012 | Gronvall | B02C 4/305 241/30 |
| 2013/0299618 | A1 | * | 11/2013 | Sharman | B02C 1/10 241/300 |

* cited by examiner

SHREDDING DEVICE AND A METHOD USING SUCH A SHREDDING DEVICE

This application is a national phase of International Application No. PCT/SE2011/050034 filed Jan. 13, 2011 and published in the English language, which claims priority to SE 1050071-8 filed Jan. 22, 2010 and SE 1051088-1 filed Oct. 19, 2010.

TECHNICAL FIELD

This invention relates to a shredding device for picking apart compressed Blocks of loose-fill cellulose thermal insulation. The invention also relates to a method to pick apart compressed loose-fill insulation using such a shredding device.

BACKGROUND

Loose-fill insulation is used to insulate structures and buildings and is a quick and convenient alternative to insulation with mineral fiber isolation sheets. The loose-fill insulation is with the assistance of compressed air blown by an insulation apparatus into cavities in the building structure, such as for example into walls and on attics, forming a heat and cold insulation layer. The insulation used is mainly made of mineral fiber or cellulosic fiber such as pulp or pieces of paper. In order for the cellulosic fibers to be able to withstand the various conditions in building structures it is treated with various additives having fire retardant and other properties. Cellulosic fibers are organic and are therefore an environmental friendly and renewable insulation material. Loose-fill cellulose thermal insulation can be made out of recycled or newly produced paper cut into smaller pieces. These cut pieces of paper are easy and economic to produce and have a good insulation capacity at a relatively low density.

A known method of insulating building structures with loose-fill cellulose thermal insulation material can be described as follows. The loose-fill cellulose thermal insulation material is compressed into a density of 90-140 kg/m3 and put into bags to be transported to the building site. At the building site the bag is opened and the material is put into a hopper arranged in the insulation apparatus. In the hopper there is a device for picking apart and fluff up the compressed cellulose thermal insulation material into a density and form possible to blow into the building elements by using a compressed air source. The device for fluffing up the compressed cellulose thermal insulation material has in most insulation apparatuses been one or several rotating arms making a horizontal vortex in the material. Due to the power needed to break apart pieces from the compressed material, the engine driving the rotating arms has been forced to be very powerful. With relatively long arms it is also difficult to receive an even density of the fluffed insulation material. A material with an uneven density containing lumps of material is difficult to distribute into the structure.

Normally the transportation to the building site is made by a truck and semitrailer. A material with a density of 90-140 kg/m$^3$ contains a large amount of air and only fills 30-50% of the trailer volume. It is therefore desirable to compress the loose-fill insulation material to a greater extent. However, due to the great amount of energy needed to break apart a compressed material it is difficult to use an even more compressed loose-fill material in an insulation apparatus according to the above description.

Further, when filling the apparatus with compressed insulation a great amount of dust arises from the open volume containing the loose-fill insulation material and the working environment in the vicinity of the apparatus is deteriorated.

The above mentioned difficulty is partly addressed by an apparatus for distributing wool or other loose fill insulation described in patent application US2006/0024456 A1. In the US application a bag with compressed loose fill insulation is placed in a chute which ends with a shredder that defines cuts in the compressed material. The cut parts are then broken into smaller pieces by a mechanism arranged between the blades. To receive a complete ripping of all the material, the smaller pieces of material are also transported through a second ripper arranged after the first shredder.

The apparatus according to US2006/0024456 A1 produces a fluffed insulation easy to blow into a structure. However it requires several complicated parts and it is also space requiring and difficult to transport.

The patent application NL 8204888A also discloses a loose fill insulation apparatus, however primarily used for mineral wool. This apparatus is beating the compressed material into smaller pieces by means of long ripping arms mounted on a cylinder rotating around a horizontal axis. In order to receive a less dense and more even material also a second rotating cylinder with attached ripping arms is used.

With this apparatus a two step process is needed to completely pick apart the material to be used for insulation. Further, with longer arms more power is required to rotate the cylinder.

SUMMARY

It is an object of the invention to create a shredding device for picking apart a highly compressed block of loose-fill cellulose thermal insulation material that address some or all of the above mentioned disadvantages. The shredding device is to be used on an apparatus for insulation with loose-fill insulation. Further, it is an object of the invention to generate a method for picking apart loose-fill cellulose thermal insulation material compressed into a block.

These objects are achieved by a shredding device according to claim 1 and a method according to claim 12.

The shredding device according to claim 1 is used for picking apart compressed blocks of loose-fill cellulose thermal insulation material and it comprises a chute with a chute inlet configured to receive the compressed insulation block. Further, it comprises a shredder rotatable around a substantially horizontal axis, mounted by a chute outlet. The rotatable shredder is a cylinder with protruding pins arranged on its mantel surface. The invention is characterized in that the pins have a length shorter than the diameter of the cylinder and that the pins are adapted to grate, pick apart and fluff the insulation material from the compressed block format into a fluff material with a density less than the density of the compressed material.

When the length of the grating pins is short relative to the cylinder radius the insulation material is milled rather than beaten into a less dense material. By using short pins the compressed material in the blocks, preferably with a high density of at least 160 kg/m$^3$, can receive the required density, preferably less than 35 kg/m$^3$, in only one milling step. Thus, the protruding pins mill the compressed insulation into a fluffed material with an even and low density of high quality containing no lump, without requiring a great amount of power to rotate the cylinder. A material with a low and even density containing no lump can easily be injected into the structure to be insulated by using an insulation apparatus, without the risk of jamming the apparatus or its external pipes.

Since only one milling step is needed, only one single rotatable shredder cylinder is used to pick apart the compressed insulation.

The protruding grating pins are preferably arranged in a substantially continuous pattern spread over the whole cylinder mantel surface. Placing the pins in a continuous pattern contribute to an evenly milled insulation material and a smooth rotation of the shredding cylinder.

If the grating pins have a length of between 0.5 and 100 mm, preferably between 5 and 15 mm, and/or are distributed with a distance between 5 and 150 mm from each other—preferably a horizontal distance varying between 5 and 150 mm, more preferably between 5 and 20 mm, and a vertical distance of approximately 5 to 150 mm, more preferably between 20 and 100 mm—the insulation material is easily and completely picked apart.

The chute has preferably a substantially rectangular cross section with its height different from its width. The cross section of the chute is adapted to the dimensions of the block.

In one embodiment the chute opening has a closure part which prevents dust from exiting the inlet. When the chute opening is closed, the environment around the loose fill insulation apparatus is improved by minimizing the dust arising when the compressed insulation is picked apart.

In a further embodiment, a pivotable wall section is used as closure part. The pivotable wall is adapted to the chute so that a minimum of air flow is passing between the pivotable wall edges and the chute. Preferably, the wall is pivotable around a top edge and is in an open position only when an insulation block is passing the closure part.

In one embodiment there is a sealing placed in the chute inlet. The sealing is adapted to enclose the block and to prevent dust from exiting the inlet. The sealing may be placed in somewhere in the chute, preferably between a closure part and the rotatable shredder cylinder.

Preferably the sealing is a brush strip or some other sealing strips providing an appropriate sealing effect with a low friction against the block. The sealing can also be used as the only dust preventing arrangement. Thus, in this embodiment the closure part is not necessary.

In another embodiment the shredder device is a single unit adapted to be mounted on a loose fill insulation apparatus. It is an advantage if existing loose fill insulation apparatuses can be used when insulating buildings. Therefore, the shredder device is constructed as one single unit with the chute and the rotatable shredder cylinder mounted on a frame. The frame can be adapted to fit different types of loose fill insulation apparatuses.

In one embodiment the shredding device includes a power transmitting element adapted to rotate the shredder cylinder and in another embodiment the rotating cylinder of the shredding device is connected to and uses a power transmitting element associated with the insulation apparatus for rotating the shredder cylinder. The power transmitting element can for example be driven by electricity, hydraulics or air pressure. If the power transmitting element is included in the single shredder unit, it receives a compact design and is ready to be used as soon as it is mounted on the insulation apparatus. If the power transmitting element already mounted in the insulation apparatus is used to drive the rotation of the shredder cylinder, the shredder unit can be made cheaper and it also receives a lower weight.

The invention also relates to a method for picking apart a block of cellulose thermal insulation material with a density of at least 160 kg/m$^3$. The method is using the steps of:

Positioning the block in a chute inlet in a shredding device as described above.

Feeding the insulation block into the chute of the shredding device

Milling the insulation block by rotation of the shredding cylinder in the shredder device so that a fluffed loose-fill insulation material is formed, having a substantially even density of less than 35 kg/m$^3$ which is ready to be distributed.

A method according to the above is allowing a use of an insulation block where the loose-fill insulation material is compressed to a greater extent by making it possible to mill the high density material into a material with a less density without using a greater amount of energy.

The method can further use the step of sealing the chute opening from dust by closing the closure part after the insulation block is fed into the chute.

If the method includes closing the chute opening after the insulation block is fed into the chute, the dust arising when the block is grated is prevented from exiting the chute.

In one embodiment of the method the chute opening is automatically opened when the block touches the closure part and closed after the block has passed the closing part. If the chute opening is automatically opened and closed, the grating process can be speeded up without letting more dust enter the surroundings of the shredding device.

Please note that all the embodiments or features of an embodiment as well as any method or step of a method could be combined in any way if such combination is not clearly contradictory.

DETAILED DESCRIPTION OF EMBODIMENTS OF THE INVENTION

The invention will now be described in more detail in respect of embodiments and in reference to the accompanying drawings. All examples herein should be seen as part of the general description and therefore possible to combine in any way in general terms. Again, individual features of the various embodiments may be combined or exchanged unless such combination or exchange is clearly contradictory to the overall function of the device.

Figure 1:
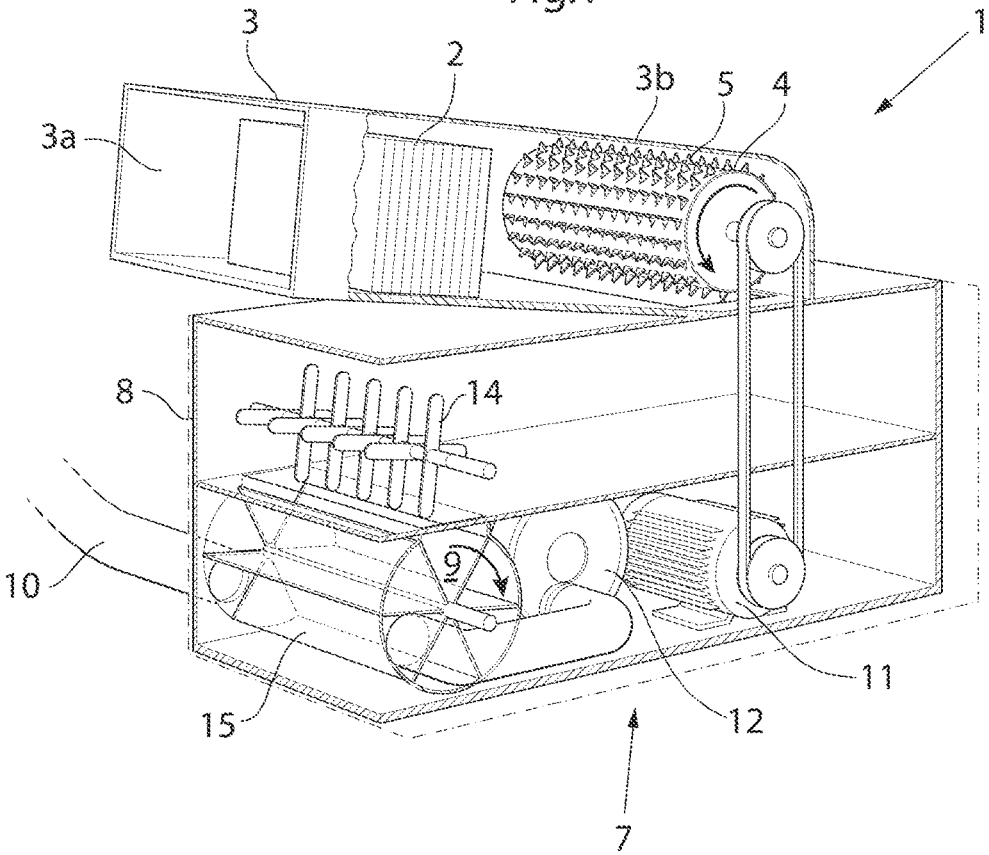
FIG. 1 discloses a first embodiment of the shredder device mounted on a loose-fill insulation apparatus, FIG. 2 discloses a second embodiment of the shredder device mounted on a loose-fill insulation apparatus, FIG. 3*a* discloses a first embodiment of the shredder cylinder, and FIG. 3*b* discloses a second embodiment of the shredder cylinder.

FIG. 1 discloses a shredding device 1 for picking apart compressed blocks 2 of loose-fill of cellulose thermal insulation material according to the invention. The shredding device 1 comprises a chute 3 with a chute inlet 3*a* in which the insulation block 2 is inserted. The chute has a substantially rectangular cross section and is adapted to receive the insulation block. The measures of the height and width of the rectangular cross section can be substantially different from each other, for example may the height of the chute be approximately 60% of the width. Other measures are of course possible. Further, the length of the chute 3 is preferably longer than a 600 mm, i.e. longer than the arm of a normal person.

In the vicinity of a chute outlet 3*b* a shredder cylinder 4 is mounted. The chute outlet 3*b* is preferably leading into a volume 8 in which the fluffed loose-fill insulation is to be stored before it is injected into structures. The shredder cylinder 4 is rotatable around a substantially horizontal axis A and has several protruding grating or milling pins 5 arranged on its mantel surface 4'. Preferably the diameter d of the shredder cylinder 4 is between 110 and 500 mm, preferably between 150 and 400 mm or approximately between 60 and 90% of the height of the chute 3. The pins 5 are adapted to grate, pick apart and fluff the insulation into a required density of preferably less than 35 kg/m$^3$. Only one single rotatable shredder cylinder 4 is needed to pick apart the compressed insulation into the preferred density. The less dense material has an even density which easily can be injected into the structure to be insulated without the risk of jamming the machine or its external pipes.

Figure 2:
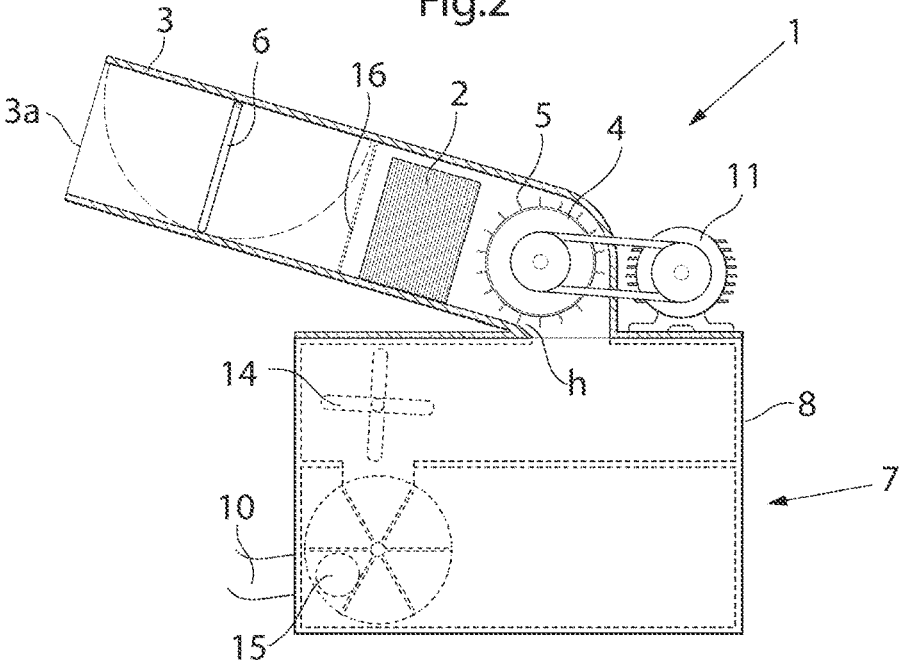

The loose-fill insulation apparatus 7 of FIGS. 1 and 2 includes a hopper 8 forming storage for the fluffed insulation and an outlet 9 to which a flexible tube 10 is mounted. Further the insulation apparatus includes a power transmitting element 11, preferably an engine rotating a drive shaft, and a compressor 12. The loose-fill insulation material has reached the hopper 8 through the shredding device 1 which has fluffed it into the required density. The required density is lower than the density of the block 2 of compressed insulation fed through the shredding device 1. Before the material is blown into the structure to be insulated, the material also passes a feeder 15 and a rotatable air lock 16, in the apparatus 7. The compressor 12 creates airflow through the air lock 16, with a pressure enough to blow the loose-fill insulation into the structure.

The rotation of the shredding cylinder is in FIG. 1 performed by the power transmitting element or engine 11 associated with the insulation apparatus.

Preferably, the engine is rotating at a speed of between 1400 and 1800 revs/min. The engine 11 is connected to a central axis of the shredding cylinder, rotating it at the required speed. In the embodiment according to FIG. 2 the shredding device includes a separate power transmitting element 13 attached to the single separate unit. The power transmitting element 13 is connected to and adapter to rotate the shredder cylinder 4. The power transmitting element 11, 13 can for example be driven by electricity, hydraulics or air pressure.

In FIG. 2 the chute inlet 3*a* is covered by a closure part 6 adapted to prevent dust from exiting the opening. The closure part 6 is a wall pivotable around its upper edge 6*a* and in its normal position it is closed and seals the chute inlet 3*a*. It is in an open position only when an insulation block 2 is passing the closure part 6 on its way towards the shredder cylinder 4. Thus, the chute inlet 3*a* is opened when the block 2 touches the closure part 6 and presses into an open position and closed after the block 2 has passed the closure part 6. He closure part may also be opened automatically by an external opening actuator operated by the operator of the device.

When the insulation block 2 is passing the closure part 6 and the closure part is opened, some dust may pass the block 2 and exit from the inlet 3*a*. Therefore a second sealing 17 can be placed in the chute 3, preferably between the closure part 6 and the chute outlet 3*b*. This second sealing 17 encloses the block 2 as long as the closure part 6 is opened. Preferably the second sealing 17 is a brush strip or some other sealing strips providing an appropriate sealing effect with a low friction against the block. The second sealing 17 can also be used as the only dust preventing arrangement. Thus the sealing 17 may be used without the closure part 6. The sealing 17 is then placed somewhere between the chute inlet 3*a* and outlet 3*b*, but preferably closer to the inlet 3*a* than the outlet 3*b*.

In FIG. 2 the shredding device 1 is constructed as a single separate unit adapted to be mounted on a loose-fill insulation apparatus 7. The chute 3 and the rotatable shredder cylinder 4 are mounted on a frame 14, which is specially adapted to fit different types of insulation apparatuses.

The distance h between the top of the grating pins 5 on the cylinder 4 and the part of the chute 3 on which the blocks 2 of compressed insulation material are transported, is adjustable. Preferably the distance is adjustable between 0 and 30 mm.

The chute 3 can be mounted at an angle relative to the ground so that the insulation block 2 is transported towards the cylinder by gravity force alone. However, the block 2 can also be automatically transported on a transporting device, for example an endless band, to the shredder cylinder 4. If the block is automatically transported into the shredder cylinder 4, the chute 3 can have any angle relative the ground. This facilitates for the operator of the device, since the insulation blocks do not have to be lifted so far from the ground level.

Figure 3A:
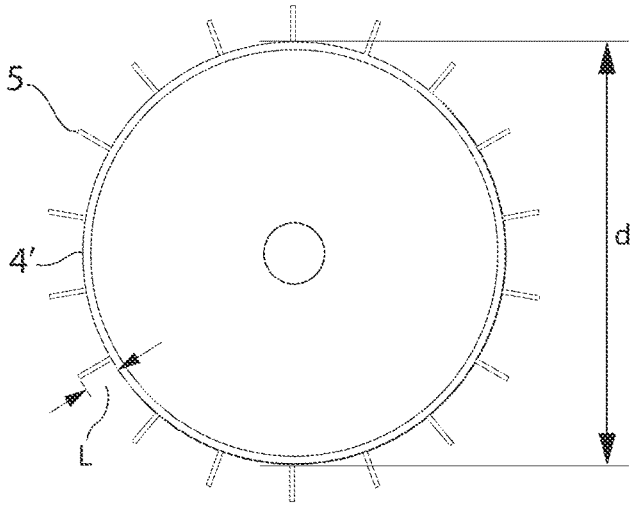

In a first embodiment of the shredder cylinder, show in FIG. 3*a*, the grating pins 5 are separate pointed parts with a length L attached to the mantel surface 4' of the shredder cylinder. They can be attached with separate fastening devices such as for example screws and rivets or they can be welded or glued to the surface 4'.

The mantel surface 4' of the shredder cylinder can also be covered by a layer of rubber or a rubberlike like material. The rubber layer can for example be vulcanized on the surface 4'. A rubber surface increases the friction between the block 2 and the cylinder 4 and further improves the grating process. Further, the grating pins 5 can easily be attached to such a surface and it is also easy to replace lost or broken pins 5.

The length L of the pins 5 is shorter than the diameter d of the shredder cylinder 4 on which the pins are attached or integrated with. Preferably the ratio between pin length and cylinder diameter L/d is between 0.001 and 0.9, or between 0.01 and 0.5, or between 0.05 and 0.15. When the length of the pins 5 is short relative to the cylinder diameter, the insulation material is milled rather than beaten into a less dens material.

The grating pins 5 can in a second embodiment be made from the same part as the shredding cylinder 4. For example can the shredder cylinder 4 consist of a base cylinder 4*a*, which can be either hollow or solid, around which a sheet of metal 4*b* is wrapped creating the cylinder mantel surface 4'.

Figure 3B:
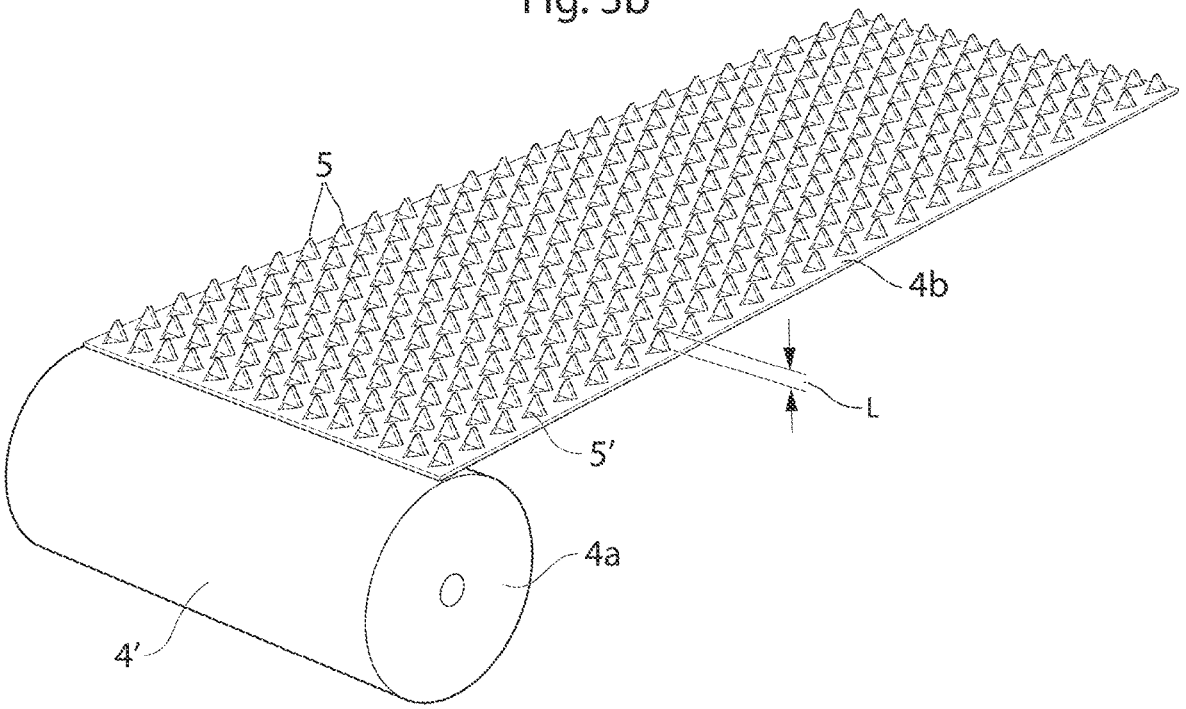

In FIG. 3*b*, this embodiment of the shredder cylinder, the pins and the making there of is disclosed. In the metal sheet 4*b* v-shaped patterns 5' are punched in a substantially continuous pattern spread over the whole sheet with a distance of 5 mm to 150 mm from each other—preferably a horizontal distance varying between 5 and 100 mm, more preferably between 5 and 20 mm, and a vertical distance of approximately 5 to 150 mm, more preferably between 20 and 100 or a minimum vertical distance of 20 mm. The grating pins are created by folding each v-shaped pattern around its top edge so that a triangular pin is formed, preferably, with a top to bottom length L of between 0.5 and 100 mm. The number of pins 5 is preferably approximately one pin per $cm^2$.

The invention claimed is:

1. A cellulose thermal insulation shredding device adapted to be mounted on a loose-fill insulation apparatus and to pick apart compressed blocks of loose-fill cellulose thermal insulation material comprising a transportation device for blocks of insulation material and a shredder rotatable around a horizontal axis and being mounted in the vicinity of the transportation device, wherein the compressed blocks of loose-fill cellulose thermal insulation material is transported towards the shredder during operation, wherein the rotatable shredder is a cylinder having a mantel surface, wherein protruding pins are arranged on the mantel surface, wherein the pins have a length shorter than the diameter of the cylinder, wherein the pins are arranged in a continuous pattern distributed across the cylinder mantel surface, and wherein the pins, during rotation of the rotatable shredder, grate, pick apart and fluff the insulation from the compressed block format into a fluff material with a density less than the density of the compressed material.

2. A shredding device according to claim 1, comprising a single rotatable cylinder.

3. A shredding device according to claim 1, wherein the pins have a length of between 0.5 and 100 mm.

4. A shredding device according to claim 1, wherein the pins are distributed with a mutual distance of between 5 and 150 mm.

5. A shredding device according to claim 1, comprising a sealing mounted in the chute opening and adapted to enclose a compressed block and to prevent dust from exiting the opening.

6. A loose fill insulation apparatus comprising a shredding device according to claim 1, wherein the loose fill insulation apparatus is a single unit, with the transportation device and the rotatable cylinder mounted on a frame mounted on the loose fill insulation apparatus.

7. A loose fill insulation apparatus according to claim 6, comprising a power transmitting element adapted to rotate the rotatable cylinder.

8. A shredding device according to claim 1, wherein the transportation device comprises a chute.

9. A shredding device according to claim 8, wherein the chute comprises a chute opening configured to receive the block of insulation material.

10. A shredding device according to claim 9, wherein the chute opening has a closure part to prevent dust from exiting the opening.

11. A shredding device according to claim 10, wherein the closure part is a pivotable wall section.

12. A method for picking apart a block made by loose-fill cellulose thermal insulation material and compressed to a density of at least 160 $kg/m^3$ by using the steps:

positioning the insulation block on the transportation device of a shredding device according to claim 1;

feeding the insulation block into the shredding device; and milling the insulation block by rotation of the cylinder in the shredder device so that a fluffed loose-fill insulation material is formed, having a substantially even density of less than 35 $kg/m^3$ which is ready to be distributed.

13. A method according to claim 12, wherein the shredding device comprises a chute with a chute inlet, the method comprising a step sealing the chute opening from dust by closing a closure part after the insulation block has been fed into the chute.

14. A method according to claim 13, wherein the chute opening is automatically opened when the insulation block touches a closure part and is automatically closed after the insulation block has passed the closure part.

* * * * *